US008640889B2

(12) United States Patent
Gasper et al.

(10) Patent No.: US 8,640,889 B2
(45) Date of Patent: Feb. 4, 2014

(54) UTILITY STORAGE RACK

(76) Inventors: Alen John Gasper, Orlando, FL (US); Fonda Gasper, Orlando, FL (US)

( * ) Notice: Subject to any disclaimer, the term of this patent is extended or adjusted under 35 U.S.C. 154(b) by 0 days.

(21) Appl. No.: 13/453,025

(22) Filed: Apr. 23, 2012

(65) Prior Publication Data

US 2012/0273443 A1 Nov. 1, 2012

Related U.S. Application Data

(60) Provisional application No. 61/480,147, filed on Apr. 28, 2011.

(51) Int. Cl.
*A47B 73/00* (2006.01)

(52) U.S. Cl.
USPC ..... 211/74

(58) Field of Classification Search
USPC ..... 211/60.1, 63, 64, 69, 70.6, 70.7, 70.8, 211/71.01, 74, 75, 77, 87.01, 163, 181.1; 206/427; 217/19; 232/41 R, 42; 312/9.2, 9.7, 245; D6/553, 567, 569, D6/570, 571; D7/600.1–600.4, 701, 707, D7/708
See application file for complete search history.

(56) References Cited

U.S. PATENT DOCUMENTS

| | | | | | |
|---|---|---|---|---|---|
| 626,325 | A | * | 6/1899 | Hopper | 217/19 |
| 877,064 | A | * | 1/1908 | Edsell | 312/9.2 |
| 938,809 | A | * | 11/1909 | Alexander et al. | 211/40 |
| 954,805 | A | * | 4/1910 | Hitchcock | 312/9.7 |
| 1,119,702 | A | * | 12/1914 | Infeld | 312/9.7 |
| 1,756,883 | A | * | 4/1930 | Russell | 211/74 |
| 2,459,333 | A | * | 1/1949 | McKinley | 217/19 |
| 2,580,676 | A | * | 1/1952 | Gross | 211/75 |
| D169,077 | S | * | 3/1953 | Mains, Jr. | D6/469 |
| 3,199,708 | A | * | 8/1965 | Shlesinger, Jr. et al. | 217/19 |
| 3,275,159 | A | | 9/1966 | James | |
| D219,058 | S | * | 10/1970 | Kaczur | D7/701 |
| 3,901,389 | A | * | 8/1975 | Belokin, Jr. | 211/74 |
| 3,984,004 | A | * | 10/1976 | Devanney | 211/133.1 |
| D267,847 | S | * | 2/1983 | Pielert | D7/707 |
| D273,647 | S | * | 5/1984 | Kandarian | D6/570 |
| D303,899 | S | * | 10/1989 | Ancona et al. | D7/600.2 |
| D303,900 | S | * | 10/1989 | Ancona et al. | D7/600.2 |
| 4,895,260 | A | | 1/1990 | Ancona | |
| D310,925 | S | * | 10/1990 | Mervar et al. | D6/567 |
| 5,025,936 | A | * | 6/1991 | Lamoureaux | 211/74 |
| 5,036,989 | A | * | 8/1991 | Carilli | 211/74 |
| D320,141 | S | * | 9/1991 | Farrell | D7/600.2 |
| 5,064,077 | A | * | 11/1991 | Mitchell | 211/60.1 |
| D329,153 | S | * | 9/1992 | Kijanka et al. | D6/467 |
| 5,183,165 | A | * | 2/1993 | Acona et al. | 211/77 |

(Continued)

*Primary Examiner* — Joshua Rodden
(74) *Attorney, Agent, or Firm* — Daniel Boudwin; Global Intellectual Property Agency, LLC

(57) ABSTRACT

The present invention improves upon storage racks with a design that accepts and organizes a plurality of bottles, cans, and other objects of varying size. The device comprises a four-sided frame having a plurality of apertures forming container members spaced thereon and adapted to hold objects of varying size. The interior frame includes a plurality of container support brackets that provide support to both the frame, and a plurality of objects stored therein. The device further comprises a plurality of apertures spaced about the front face, which creates a pegboard surface that can accept a variety of attachments for hanging objects therefrom. The present invention can further be mounted to a vertical support wall, thereby preventing the device from taking up floor our countertop space, which can then be utilized for other purposes.

10 Claims, 3 Drawing Sheets

(56) References Cited

U.S. PATENT DOCUMENTS

| | | | | | |
|---|---|---|---|---|---|
| D334,510 | S | * | 4/1993 | Ancona et al. | D7/600.2 |
| 5,228,582 | A | * | 7/1993 | Marshall et al. | 211/163 |
| D401,483 | S | * | 11/1998 | Porcelli | D7/600.2 |
| D413,491 | S | * | 9/1999 | McCauley | D7/600.2 |
| 5,947,305 | A | * | 9/1999 | Lin | 211/74 |
| 6,234,325 | B1 | * | 5/2001 | Higgins et al. | 211/74 |
| 6,729,481 | B1 | * | 5/2004 | O'Brien | 211/74 |
| D509,691 | S | * | 9/2005 | Doran | D6/571 |
| D568,697 | S | * | 5/2008 | Allen | D7/708 |
| 7,506,771 | B2 | * | 3/2009 | Bianchini | 211/75 |
| D590,183 | S | * | 4/2009 | Hensel | D6/457 |
| 7,987,983 | B1 | * | 8/2011 | Guitreau | 206/443 |
| 8,061,538 | B2 | * | 11/2011 | Seldon | 211/74 |
| D661,952 | S | * | 6/2012 | Tiemann | D7/600.1 |
| D673,821 | S | * | 1/2013 | Weber et al. | D7/701 |
| D675,490 | S | * | 2/2013 | Dara | D7/701 |
| 8,403,156 | B1 | * | 3/2013 | Boone | 211/75 |
| 2007/0108145 | A1 | * | 5/2007 | Milardo et al. | 211/74 |
| 2011/0204010 | A1 | * | 8/2011 | Hastu et al. | 211/74 |

* cited by examiner

UTILITY STORAGE RACK

CROSS REFERENCE TO RELATED APPLICATION

This application claims the benefit of U.S. Provisional Application No. 61/480,147 filed on Apr. 4, 2011, entitled "Zacley Storage Unit."

BACKGROUND OF THE INVENTION

1. Field of the Invention

The present invention relates to a utility storage rack. More specifically, the present invention pertains to a utility storage rack having a pegboard, as well as a plurality of aperture forming container members that are adapted to holding and organizing objects of varying size.

Providing an efficient system of organization for items of varying size and shape can be a difficult and time-consuming task. This is particularly true in the home, where a variety of objects need to be stored and organized. It is well known that conventional storage spaces, such as cabinets, shelves, and pantries, do not provide an efficient means of organization for items of varying size. These objects are traditionally placed loosely in a cabinet, aligned on a shelf, or placed in the bottom of a toolbox. In addition to larger items, such as bottles and spray cans, smaller objects that are intended for hanging on a rack are difficult to properly store. Additionally, the storage racks available and disclosed in the prior art do not include a means of hanging such objects, which often causes a user to place such items in a drawer where they are difficult to organize.

It is well known that maintaining organization in the home is a difficult and time-consuming task. Two locations in the home that are particularly difficult to organize are the garage and kitchen. Garages contain various items, such as spray paint cans, penetrating oil containers, insect sprays, and hand tools, which are traditionally placed into a cabinet, toolbox, or shelf. Over time, as more items are acquired, these spaces become quickly disorganized. In addition to the garage, the modern kitchen contains various cooking spices, sprays, and cooking utensils that require additional storage space. This is particularly true in homes and apartments that have a smaller kitchen, where storage space is often limited. Constantly removing, replacing, and reorganizing these storage areas is time consuming, as well as an inefficient use of the limited space available.

Such lack of organization can create difficulty when attempting to locate a desired object. A user must remember which location the item is in, and then search through the storage space until the item is located. Many times, these various items are arranged one in front of the other, making it difficult to access a particular item that is positioned in the back. In such cases, a user must remove all of the containers that are stored in front of the needed item in order to obtain access thereto. In addition, the devices that presently exist in the art for organizing objects of varying size are not intended to hang on a wall. Instead, such devices take up floor and countertop space, which is an inefficient use of the available wall space in the kitchen or garage. The present invention improves upon traditional storage devices by providing a means of organizing items of varying size. The device comprises a four-sided wall utility rack having a plurality of aperture forming container members arranged in vertical columns, which are adapted to holding objects of varying size and shape. The rear face includes a means of attaching the device to a vertical support surface, while the front face contains a plurality of apertures spaced about a substantial portion thereof, forming a pegboard for attaching objects thereto. In this way, a user can store larger items in the container members, while smaller items can hang from the pegboard. This enables a user to quickly locate and replace such items, thereby creating a more efficient storage space.

2. Description of the Prior Art

Presently, a common way to store objects of varying size is with a counter mounted storage rack that includes a plurality of apertures that are designed to secure items placed therein. Many of the devices that are currently available or disclosed in the prior art, however, utilize a design that requires the storage rack to be positioned on the floor or on a countertop. Such devices take up valuable space that may be better used for storing other items. Additionally, many of the devices in the prior art do not include a means of hanging small objects therefrom, such as hand tools or kitchen utensils. These items are left to be stored in a location where they can easily be misplaced or lost.

The present invention improves upon currently available and disclosed devices with a design that can be mounted to a vertical wall surface, and enables a user to store a plurality of objects of varying size. The rear face includes a means of attaching the device to a support surface, such as a door or wall. This prevents the device from using floor our countertop space, thereby enabling a user to better utilize such spaces. The front face includes a pegboard that can accept a plurality of attachments for hanging items therefrom. The present invention additionally includes a means of storing a plurality of containers, such as bottles, cans, or other containers of varying size. This design enables a user to store many different types of objects in one location, instead of requiring multiple storage solutions for items of varying size, thereby providing a novel device over those in the prior art.

Several devices have been disclosed in the art that attempt to store and organize cylindrical objects. Deviancy, U.S. Pat. No. 3,984,004 discloses a display and storage assembly having an arcuate front face with openings therein for receiving, storing and displaying goods. Alexander, U.S. Pat. No. 938,809 discloses a holder comprising a revolvable cylinder designed to receive and hold phonographic records. Russell, U.S. Pat. No. 1,756,883 discloses a display support for bottles of oil, alcohol, or the like. James, U.S. Pat. No. 3,275,159 discloses a display cabinet for holding round, cylindrical containers, such as spray paint cans. While such prior art devices are useful for storing and displaying objects, the structure of these devices are considerably different from the present invention. These racks are intended for positioning on a floor, and are designed for holding similarly shaped consumer items in a commercial setting. They are not adapted to holding items of varying size, such as tools or kitchen utensils. Additionally, these devices do not include a means of attaching to a support surface, such as a vertical wall surface. The present invention overcomes such limitations by providing a pegboard on the front surface for attaching small items thereto. In this way, the present invention can store several different types of objects of varying size and shape.

Other devices in the prior art claim storage devices used for holding cylindrical items. Ancona, U.S. Pat. No. 4,895,260 discloses a device for holding and displaying a plurality of cylindrical containers that is mounted to a rotating base. Similarly, Ancona, U.S. Pat. No. 5,183,165 discloses a kitchen storage unit that includes apertures for receiving cylindrical containers, as well as pegs for hanging small items therefrom. While these devices are designed for holding objects of varying size, there structure is entirely different. The '260 and '165 patents include apertures on multiple sides, as well as rotating bases. When access is required to the apertures on a side of the device facing away from the user, the storage rack must be rotated in order to allow for access thereto. To permit such rotation, the device must be mounted on a flat surface, such as a countertop. The present invention includes a rear face that enables the device to be mounted on a vertical support surface. When mounted, a user can access all sides of the device without rotation, thereby enabling a user to utilize countertop space for other items.

While the devices disclosed in the prior art are designed to hold and organize objects of varying size, they have several known drawbacks. Many of these storage racks are designed for use in a commercial setting, such as in a department store. They are intended to be positioned on a floor for holding and displaying goods for consumers. Other devices disclosed that are for use in a kitchen are intended to be placed on a countertop, which is an inefficient use of the limited space available in a kitchen. The present invention overcomes such difficulties with a design that is wall mountable, and does not require the use of floor or countertop space. The configuration of the container members allows for the storage of bottles, cans, or other containers of varying size. The pegboard on the front face allows for the hanging of various objects therefrom. This creates a simple and efficient storage solution for the home or any other space where organization is desired.

In light of the prior art and the disclosed elements of the present invention, it is submitted that the present invention substantially diverges in design elements from the prior art. Consequently, it is clear that that present invention is not described by the art, and that a need exists for an improved utility storage rack having a pegboard, as well as a plurality of aperture forming container members that are adapted to holding and organizing objects of varying size. In this regard the instant invention substantially fulfills these needs.

SUMMARY OF THE INVENTION

In view of the foregoing disadvantages inherent in the known types of storage racks now present in the prior art, the present invention provides a new and improved storage rack wherein the same can be utilized for providing convenience for the user when storing and organizing objects of varying size.

It is therefore an object of the present invention to provide a new and improved storage rack that has all of the advantages of the prior art and none of the disadvantages.

It is another object of the present invention to provide a new and improved storage rack for storing objects of varying size.

Another object of the present invention is to provide a four-sided storage rack having a pair of angled faces that each comprise a plurality of aperture forming container members arranged in vertical columns that are adapted to holding objects of varying size and shape. The angled faces orient the items towards a user when the user is directly in front of the rack, which allows for ease of insertion and removal of the containers from the rack.

A further object of the present invention is to provide a new and improved storage rack that can be mounted to a vertical wall surface, thereby preventing the device from taking up space on a countertop or floor.

Another object of the present invention is to provide a new and improved storage rack having a front face that contains a plurality of apertures spaced about a substantial portion thereof that forms a pegboard, which can accept a variety of attachments for hanging objects therefrom.

Yet another object of the present invention is to provide a new and improved storage rack with a plurality of container support brackets that support the containers placed in the aperture forming container members.

A further object of the present invention is to provide a new and improved storage rack that stores various items in a manner whereby they are easily identified and accessed.

A final object of the present invention is to provide a new and improved storage rack that may be readily fabricated from materials that permit relative economy and commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
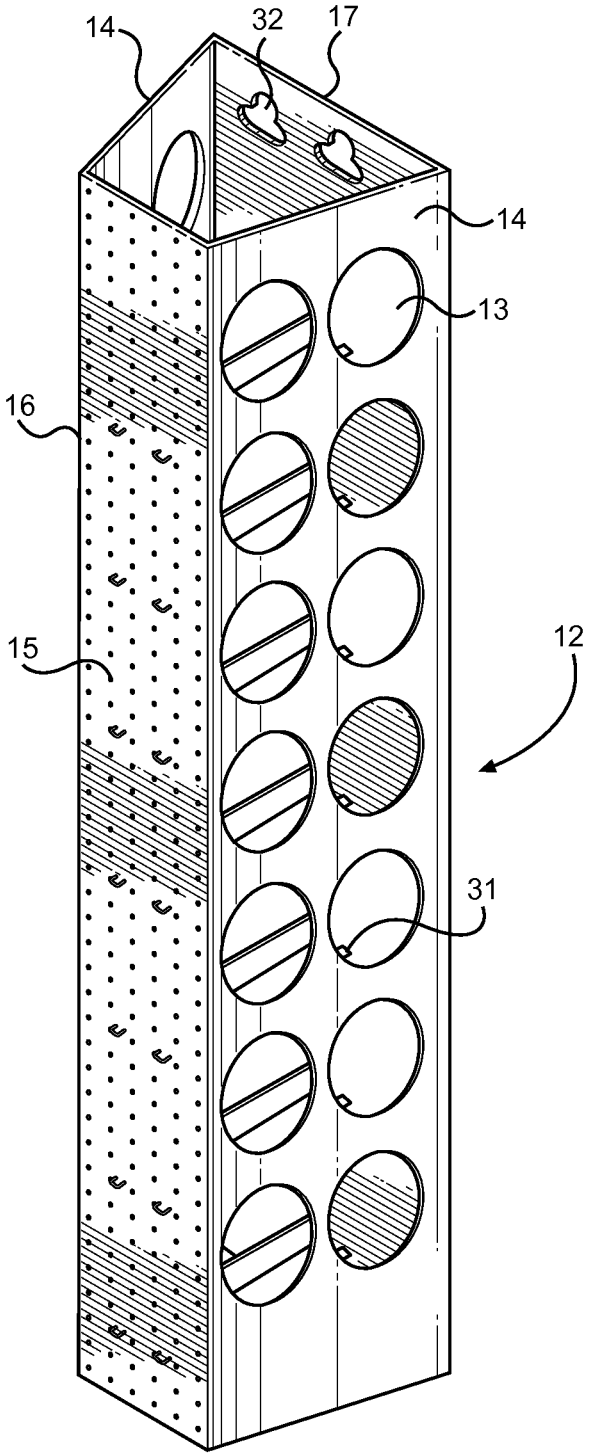
FIG. 1 shows a perspective side angle view of the present invention, with the container support brackets visible through apertures forming container members.

Reference is made herein to the attached drawings. Like reference numerals are used throughout the drawings to depict like or similar elements of the storage rack. For the purposes of presenting a brief and clear description of the present invention, the preferred embodiment will be discussed as used for storing bottles, cans, or other cylindrical containers, as well as various kitchen utensils. The figures are intended for representative purposes only and should not be considered to be limiting in any respect.

Referring now to FIG. 1, there is shown a view of the present invention, which comprises a frame 12 having a four-sided cross section that creates a front face 16, a rear face 17, and a pair of side faces 14, each having a plurality of aperture forming container members 13 spaced about a substantial portion thereof that are adapted to holding objects of varying size. The interior of the frame 12 is generally open, and includes a plurality of container support brackets 31 that provide support to the frame 12, and enable the device to support a plurality of objects stored therein. The front face 16 of the frame 12 contains a plurality of apertures 15 spaced about a substantial portion thereof creating a pegboard. This enables the front face 16 to accept a plurality of attachments for hanging various items therefrom. The apertures form container members 13 that are arranged in vertical columns along the side faces 14, and are adapted to holding objects of varying size and shape therein. The rear face 17 of the frame 12 includes a means for securing the device to a vertical support surface, such as a door or wall.

The rear face 17 of the frame 12 includes a means for securing the present invention to a support surface, such as a wall or door. As can be appreciated by a person skilled in the art, the securing means can comprises a plurality of fastener accepting apertures 32 spaced about the rear face 17, each fastener accepting aperture 32 having a smaller portion towards the top of the frame 12, and a larger portion towards the bottom thereof. This enables a fastening means having a head, such as a nail or screw, to be placed through the fastener accepting aperture 32 to secure the frame 12 to a support surface. The lower portion of the fastener accepting aperture 32 is large enough to enable the fastening means to pass therethrough. Once the fastening means is placed through the lower portion of the fastener accepting aperture 32, the frame 12 is lowered so that the fastening means rests on the upper portion of the fastener accepting aperture 32, which is smaller than the head of the fastening means. The weight of the frame 12, as well as the objects stored therein, prevent the frame 12 from being removed from the support surface unless it is lifted up to enable the fastening means to pass through the lower portion of the fastener accepting apertures 32. Alternately, a flush bracket with a plurality of apertures can be provided for receiving a fastening means. The bracket is preferably molded as part of the rear face 17 such that the bracket and rear face 17 are formed as a single piece. The bracket is substantially flush with the rear face of the frame, as to prevent interference with the bracket, fastening means, and support surface.

Figure 2:
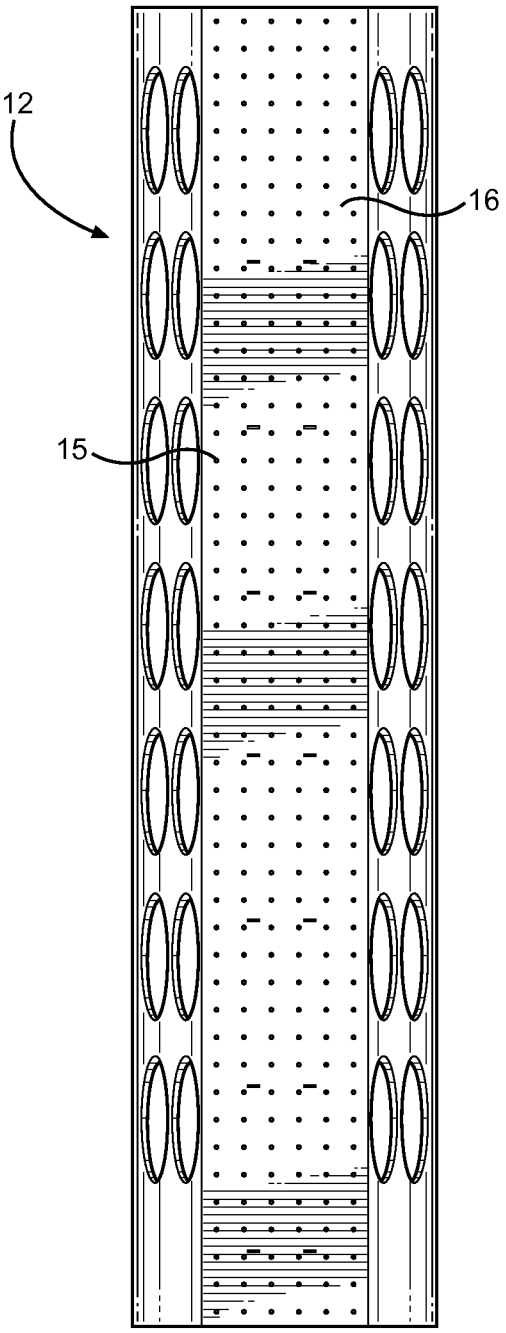
FIG. 2 shows a perspective view of the present invention, wherein the front face contains a plurality of apertures spaced about a substantial portion thereof forming a pegboard.

Referring now to FIG. 2, there is shown a perspective view of the present invention, wherein the front face 16 contains a plurality of apertures 15 spaced about a substantial portion thereof forming a pegboard. In the preferred embodiment, the plurality of apertures 15 is arranged at regular intervals or intermittently about the front face 16. The plurality of apertures 15 extend through the front face 16 and into the interior of the frame 12. This enables an attachment to be secured through the apertures 15 for hanging various objects on the front face 16 of the frame 12.

There are an assortment of attachments and connectors presently available in the art that are designed to engage the apertures 15 on the planar front face 16 of the frame 12. As an example, a hook with a first end that passes through one of the apertures 15 on the front face 16, and a second end extending downwardly along the front face 16, and then curving out and away. The hook may also include a peg on the back that engages a second aperture 15, adding stability thereto. Any of a variety of objects may be hung on the attachments, such as hand tools, kitchen utensils, oven mitts, or decorative items. Because the front face 16 includes a plurality of apertures 15 at regular intervals, the attachments may be placed in a variety of positions, thereby providing convenience to a user as well as ease of organization.

Figure 3:
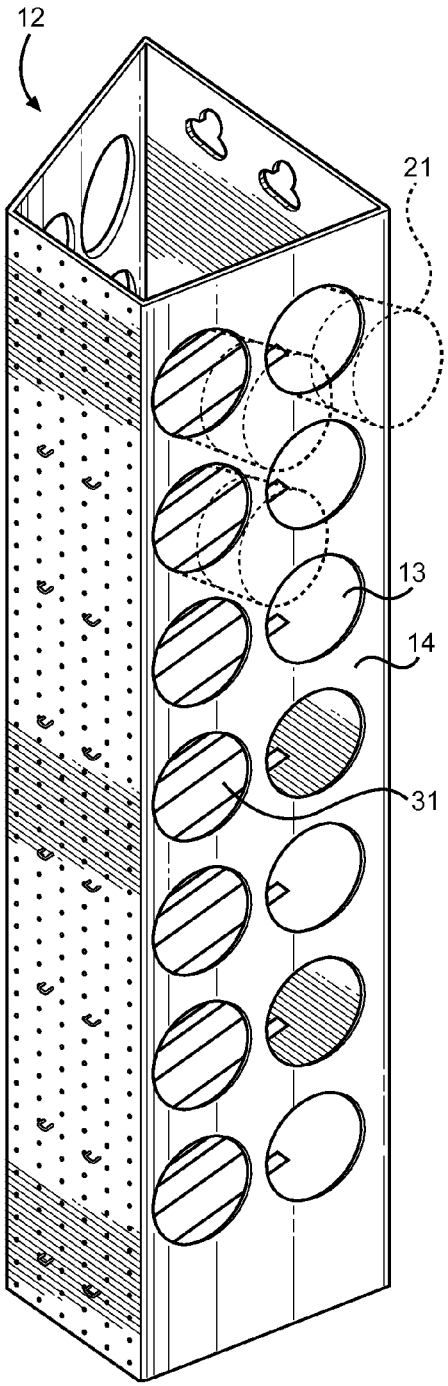
FIG. 3 shows a perspective side angle view of the present invention, with a plurality of objects supported in apertures forming container members by the container support brackets.

Referring now to FIG. 3, there is shown a perspective side angle view of the present invention, with a plurality of objects supported in the aperture forming container members 13 by the interior container support brackets 31. The frame 12 includes a plurality of aperture forming container members 13 that are arranged in vertical columns along the side faces 14, and are adapted to hold objects of varying size and shape therein. The side faces 14 act as a vertical support wall for the aperture forming container members 13, as well as the containers 21 stored therein. In the preferred embodiment, each side face 14 includes a pair of vertical rows of aperture forming container members 13 that are each created by an aperture in the side face 14.

As shown in the drawings, the aperture forming container members 13 are circular, which enable the storage of circumferential shaped containers 21. As can be appreciated by one of skill in the art, the circular shape of the aperture forming container members 13 is illustrative only, and not intended to limit the shape of aperture forming container members 13, which may be square, rectangular, or any shape necessary to support the shape of the container 21 stored therein.

Figure 6:
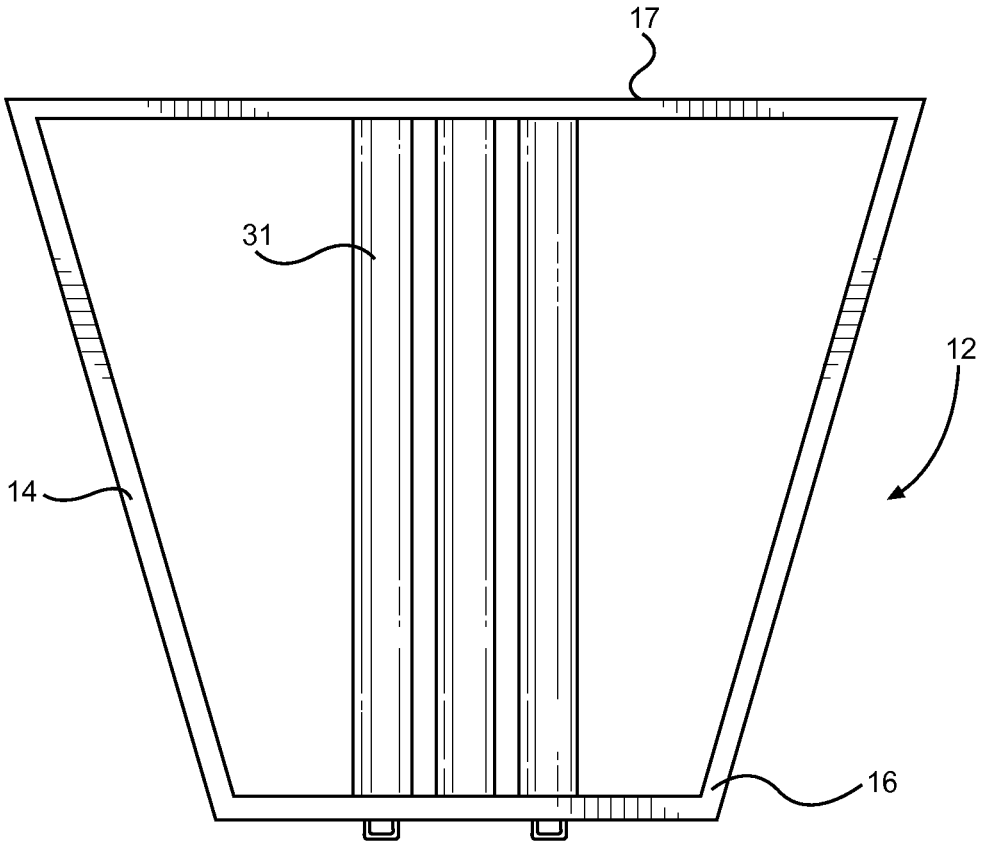
FIG. 6 shows an overhead view of the container support brackets on the interior of the support rack, in this embodiment the container support brackets are a set of dowels in triangular formation.

A container 21 is inserted through the container member 13 in the side face 14, until it makes contact with the container support bracket 31. The container support bracket 31 provides an interior support structure to prevent the entire container 21 from entering into the frame 12. The container support brackets 31 form an interior shelf, with a raised central section that acts as a vertical support wall between opposing containers 21 stored in opposing sides of the aperture forming container members 13. The height of the container support brackets 31 can vary with respect to the container members 13. The shelf created by the container support brackets 31 can be aligned with the apertures in the container members 13, causing the containers 21 stored therein to rest at a substantially horizontal position. In an alternate embodiment, the container support brackets 31 can be aligned below the container members 13, causing the containers 21 stored therein to rest at an angle, with the outer ends of the containers resting higher than the ends making contact with the container support brackets 31. In this embodiment, the apertures forming in the container members 13 can be angled down towards the container support brackets 31. In yet another embodiment of the support brackets shelf, in which two horizontal and one vertical support wall is provided, a plurality of dowels may be utilized in place of the bracket to support the containers in the same fashion and facilitating the same function as the three sided bracket. This configuration is shown in the overhead view of FIG. 6. Three dowels are situated in a triangular pattern, such that a container may rest against two of the dowels when inserted into the container apertures and rested against the interior dowels.

Figure 4:
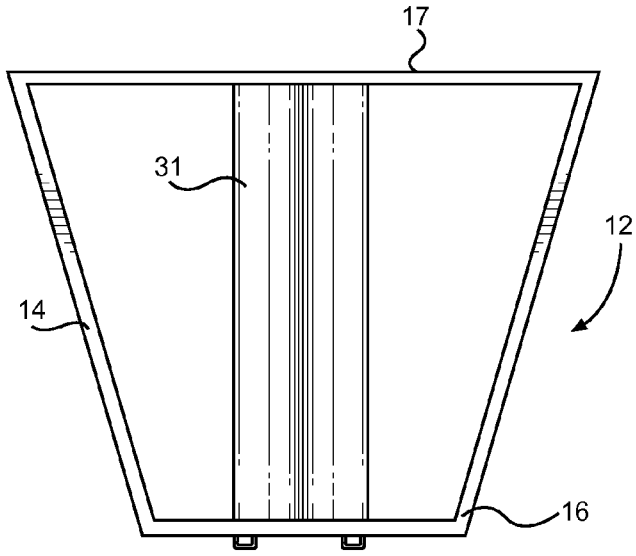
FIG. 4 shows an overhead view of the container support brackets on the interior of the support rack.

Referring now to FIG. 4, there is shown an overhead view of the container support brackets 31 on the interior of the frame 12. In the preferred embodiment, the rear face 17 comprises a greater width than the front face 16, thereby causing the four-sided frame 12 to form a trapezoid shape. As can be appreciated, a trapezoid shape places the side faces 14 at an angle with respect to the support surface the storage frame 12 is mounted thereto. This provides convenience for a user when storing a plurality of containers in the aperture forming container members 13. The angle of the side faces 14 positions the containers stored within the aperture forming container members towards a user when he or she is directly in front of the frame 12. This provides convenience to a user when inserting and removing the containers from the frame 12.

The container support brackets 31 attach to the inside of the frame 12 at the interior of the front face 16 and the rear face 17. This provides the device with an additional support brace on the interior of the frame 12. The container support brackets 31 provide an interior shelf for supporting an object stored therein. The middle of the container bracket 31 is raised, which creates a divider between objects stored on either side of the container bracket 31.

Figure 5:
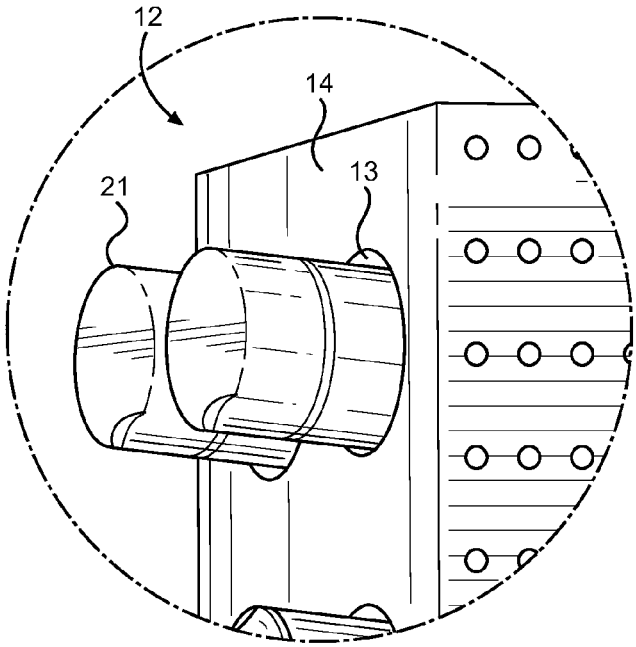
FIG. 5 shows a close up perspective view of the aperture forming container members with a plurality of objects supported therein.

Referring now to FIG. 5, there is shown a close up perspective view of the aperture forming container members 13 with a plurality of containers 21 supported therein. The distance between the side face 14 and the container support bracket is determined by the height of an item to be supported therein. The distance between the side face 14 and the container support bracket 31 is such that approximately half the height of the object must be contained within the interior of the frame 12, which prevents the container 21 from falling out of the container member 13. In this way, the container 21 is securely maintained therein, with at least a portion of the object extending from the container member 13. A container 21 is turned on its side and inserted into the frame 12 through the container member 13, until it comes to rest on the container support bracket 31.

The several elements of the frame 12 may be readily fabricated from materials permitting relative economy and durability. For example, the rectangular frame 12 can be configured as a one-piece unit. Additionally, the frame 12 can be configured as three separate pieces that are held in place by seams at the edges. The several elements of the frame 12 are fabricated from the same material so that solvent bonding may be readily employed. Additionally, the frame 12 can be formed from a variety of convenient materials, such as plastic, wood, particleboard, or metal.

The present invention provides a user with a convenient and inexpensive device for storing bottles, cans, or other objects of varying size. The device mounts on a vertical wall surface, which allows a user to place other required devices on countertops or floors, such as small appliances or decorative pieces. The container members hold the various items in an easily identifiable and secure manner, which allows a user to quickly locate a required container when needed. The plurality of apertures on the front face allow for the attachment of various connectors, which give a user a wide variety of options for storing various goods thereon.

With regards to the present disclosure, it is submitted that the present invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A device for holding and displaying a plurality of objects, comprising:

a four-sided frame having a trapezoidal cross section comprising a vertically planar front face, a vertically planar rear face, and a pair of vertically planar angled side faces, said faces defining an open interior space with an open top and bottom, and wherein the distance between said side faces is greater at said rear face than at said front face;

said side faces having a plurality of container member apertures spaced thereon and adapted to support objects placed therethrough said apertures;

a plurality of interior container supports centrally disposed and aligned in a vertical column, each of said container supports having a first and second end, said first end connecting to said front face, said second end connecting to said rear face to provide support to said frame and adapted to provide support for objects stored in said container member apertures.

2. The device of claim 1, wherein said front face further comprises a pegboard surface having a plurality of apertures spaced thereon, said pegboard being adapted to accept a variety of connectors.

3. The device of claim 1, wherein said rear face further comprises a securing means that removably secures said frame to a support surface.

4. The device of claim 1, wherein said interior container supports further comprise an interior shelf with a raised central section that acts as a vertical support wall between said objects stored in opposing sides of said container member apertures.

5. The device of claim 1, wherein said frame is a unitary structure.

6. The device of claim 1, wherein said frame is constructed of a plurality of segments connected at their edges.

7. The device of claim 1, further comprising a securing means that removably secures said frame to a support surface, wherein said securing means is a plurality of apertures spaced about said rear face, said apertures having a smaller portion towards a top of said frame and a larger portion towards a bottom of said frame, thereby enabling a fastening means having a head to be placed through said aperture to secure said frame to said support surface.

8. The device of claim 1, further comprising a securing means that removably secures said frame to a support surface, wherein said securing means is a flush bracket with a plurality of apertures, said bracket being substantially flush with said rear face.

9. The device of claim 1, wherein said interior container supports further comprise a three sided bracket having a first and second horizontal portion connecting to a central vertical section.

10. The device of claim 1, wherein said interior container supports further comprise a plurality of dowels in a triangular pattern, wherein two lower dowels are positioned below a central upper dowel.

* * * * *